US005722627A

United States Patent [19]

Hoshino

[11] Patent Number: 5,722,627

[45] Date of Patent: Mar. 3, 1998

[54] MECHANISM FOR ADJUSTING THE HEIGHT OF A DRUM CHAIR OR THE LIKE CHAIR

[75] Inventor: Yoshihiro Hoshino, Nagoya, Japan

[73] Assignee: Hoshino Gakki Kabushiki Kaisha, Japan

[21] Appl. No.: 794,318

[22] Filed: Feb. 3, 1997

[30] Foreign Application Priority Data

May 28, 1996 [JP] Japan ..... 8-157669

[51] Int. Cl.[6] ..... F16M 11/24; A47C 3/00

[52] U.S. Cl. ..... 248/405; 248/188.4; 297/344.18; 297/344.22; 405/110

[58] Field of Search ..... 297/452.2, 344.18, 297/344.21, 344.22, 344.12; 248/188.4, 413, 405; 403/97, 110, 373, 374, 362

[56] References Cited

U.S. PATENT DOCUMENTS

| | | | |
|---|---|---|---|
| 3,161,396 | 12/1964 | Anderson | 248/405 |
| 3,203,657 | 8/1965 | Thompson | 248/413 |
| 3,391,893 | 7/1968 | Doerner | 248/405 |
| 3,406,939 | 10/1968 | Doerner | 248/405 |
| 4,253,632 | 3/1981 | Doerner | 248/405 |
| 4,655,426 | 4/1987 | Von Dulong et al. | 248/405 |
| 4,828,212 | 5/1989 | Dicks | 297/344.12 |

*Primary Examiner*—Peter M. Cuomo
*Assistant Examiner*—Anthony D. Barfield
*Attorney, Agent, or Firm*—Ostrolenk, Faber, Gerb & Soffen, LLP

[57] ABSTRACT

A chair height adjusting mechanism including an externally threaded upper support supporting a chair seat, a tubular lower support into and out of which the upper support is movable. An internally threaded rotatable member rotatable up and down along the upper support. An upper gearing surface on the underside of the rotatable member. A fixed member around the upper support and through which the upper support is slidable. A tightening part for clamping the fixed member on the upper support. The fixed member having a lower gearing surface meshable with the gearing surface on the rotatable member so when they are in mesh, the rotatable member is held stationary. Support legs on the lower support and also connected with the tightening part.

8 Claims, 8 Drawing Sheets

MECHANISM FOR ADJUSTING THE HEIGHT OF A DRUM CHAIR OR THE LIKE CHAIR

BACKGROUND OF THE INVENTION

This invention relates to a mechanism for adjusting the height of a chair, and particularly of a drum chair.

THE PRIOR ART

FIG. 9 hereof shows an ordinary chair 60, particularly for use with a drum. This chair 60, includes an upper support 65 which carries a seat 61. The upper support extends up from a lower support 75. The lower support is equipped with a leg section 71 designed such that the height of the seat may be freely adjusted. The seat 61 includes a cushion 63 on the upper surface of a seat plate 62. The seat plate 62 is installed at the top of the upper support 65. In this example, an upper support holder 64 is formed approximately at the center of the lower surface of the seat plate 62. When the upper end of the upper support 65 is inserted in the holder 64 and a bolt B1 is tightened to the holder, the seat plate 62 is securely held so as to be freely detachable and re-attachable.

FIG. 10 shows an outer screw thread 66 on the outer peripheral surface of the upper support 65. The lower part of the threaded upper support is inserted into the inner tubular part 77 of the lower support 75 through the adjusting part 76.

The lower support 75 supports a known leg section 71 that is capable of being opened or closed radially. The adjusting part 76 at the top of the inner tubular part 77 is also tubular, with an inner spiral or screw thread 74 on its inner surface so that the inner tubular part can be moved along the outer spiral screw thread 66 of the upper support 65 by rotating the part 76. A screw hole 78 into the side surface of the part 76 opens to the inner peripheral surface of the part 76, and a tightening bolt B2 is installed in the hole 78. A holding plate 79 acts as a contact buffer between the bolt B2 and the screw thread 66 of the upper support.

With the tightening bolt B2 loosened, rotating the seat 61 either lowers or raises the upper support 65 into or out of the inner tubular part 77 of the lower support 75. After the cushion 63 reaches a desired height, the bolt B2 is tightened until the upper support 66, which passes inside the adjusting part 76, is pressed against. This determines the height of the seat.

If the seat 61 is rotated once, the cushion 63 moves only by a height corresponding to one spiral pitch of the outer spiral 66 of the upper support 65. This is convenient for a fine adjustment of the height of the seat. However, when the height of the cushion 63 is to be changed substantially, the seat 61 has to be rotated many times, which may be troublesome to the user. For a chair having a back support for the person seated, moreover, rotating the seat 61 in a narrow space would sometimes cause the back support to hit either the person or the surrounding wall, etc. In the case of such a chair where the direction is set as described above, moreover, the elevation of the seat depends upon the pitch of the screw. As a result, delicate adjustment of the height may bring about a divergence in the direction of the chair.

FIG. 11 shows another known embodiment for inserting an upper support 65A in the form of a pipe, etc. to a desired length into an inner tubular part 77A of a lower support 75A and for fixing the upper support 65A at the top of the inner tubular part 77A of the lower support 75A through a tightening member 76A.

The tightening member 76A comprises a tubular body that is supported at the top of the inner tubular part 77A. A screw hole for screwing in of a tightening bolt B3 is provided on the side of the member 76A.

In addition, a tightening part 78A, through which the upper support 65A freely slides, is provided inside the tightening member 76A. The position of the upper support 65A is fixed as the upper support 65A is pressed by the tightening bolt B3 through the tightening part 78A. This height is changed by loosening the tightening bolt B3 and by sliding the upper support 65A vertically with respect to the lower support 75A. This enables the height to be changed quickly. If the tightening bolt B3 is loosened during adjustment, however, the seat drops due to its own weight. This makes it necessary to hold up the seat by hand at a desired height which is inconvenient. In addition, there are cases when the upper support is moved excessively or when its fixed position is moved, thereby making it difficult to make a fine adjustment of the height. Moreover, the tightening bolt B3 may be loosened by vibrations caused during a drum performance, which would free the seat to fall. Thus, it has been necessary to fix the tightened position of the upper support 65A through the use of a stopper S.

SUMMARY OF THE INVENTION

The object of the invention is to provide a chair height adjustment mechanism which permits both a substantial height adjustment and also a micro-adjustment of the height to be carried out quickly, easily and accurately, and which can be used confidently without loosening the tightening bolt between the supports.

In other words, this invention relates to a chair height adjustment mechanism for free adjustment of an upper support which is equipped with a chair seat. The upper support has an outer screw thread. A lower support includes a support leg section. The lower support has an inner tubular part with which the upper support is inserted. A rotatable adjustment member has lower rotation resisting elements, e.g. gearing surface, formed on its lower surface. It is internally threaded so as to be freely movable in the vertical direction in the upper support by rotating the adjustment member. A fixing member has on its upper surface rotation resisting elements, e.g. a upper gearing surface that meshes with the lower gearing surface of the rotatable member for inhibiting rotation of the adjustment member. A tightening part at the top of the lower support compressively tightens the upper support by a tightening bolt.

Other objects and features of the invention are explained below with reference to the attached drawings.

DESCRIPTION OF A PREFERRED EMBODIMENT

Figure 1:
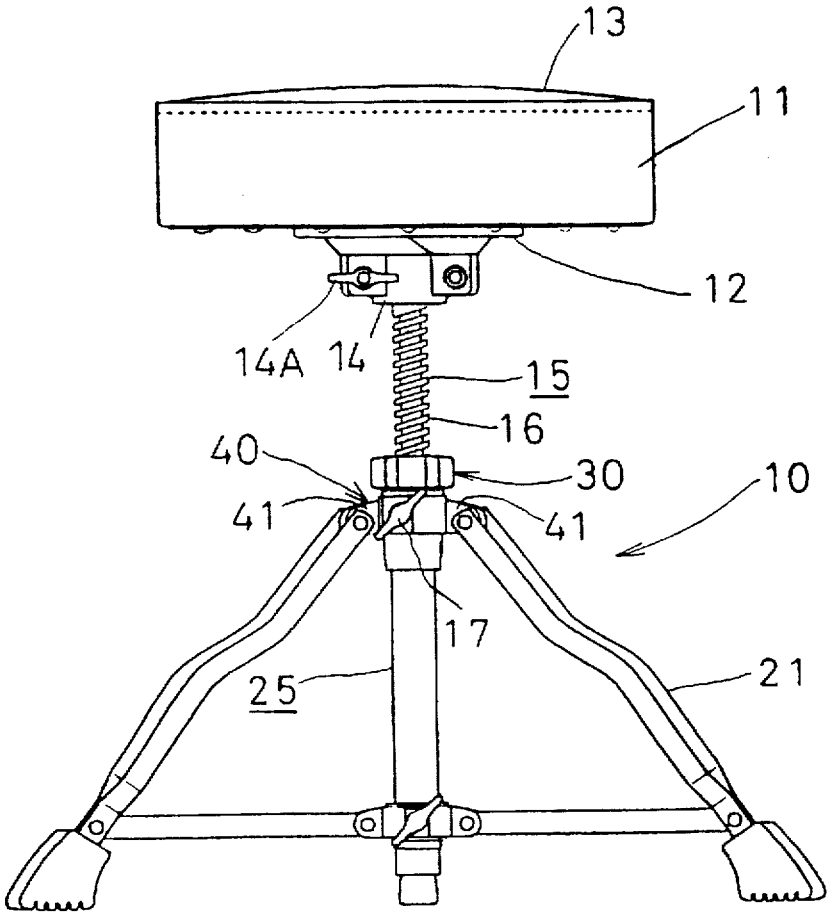
FIG. 1 is a front view of a drum chair having the mechanism of the invention.
Figure 2:
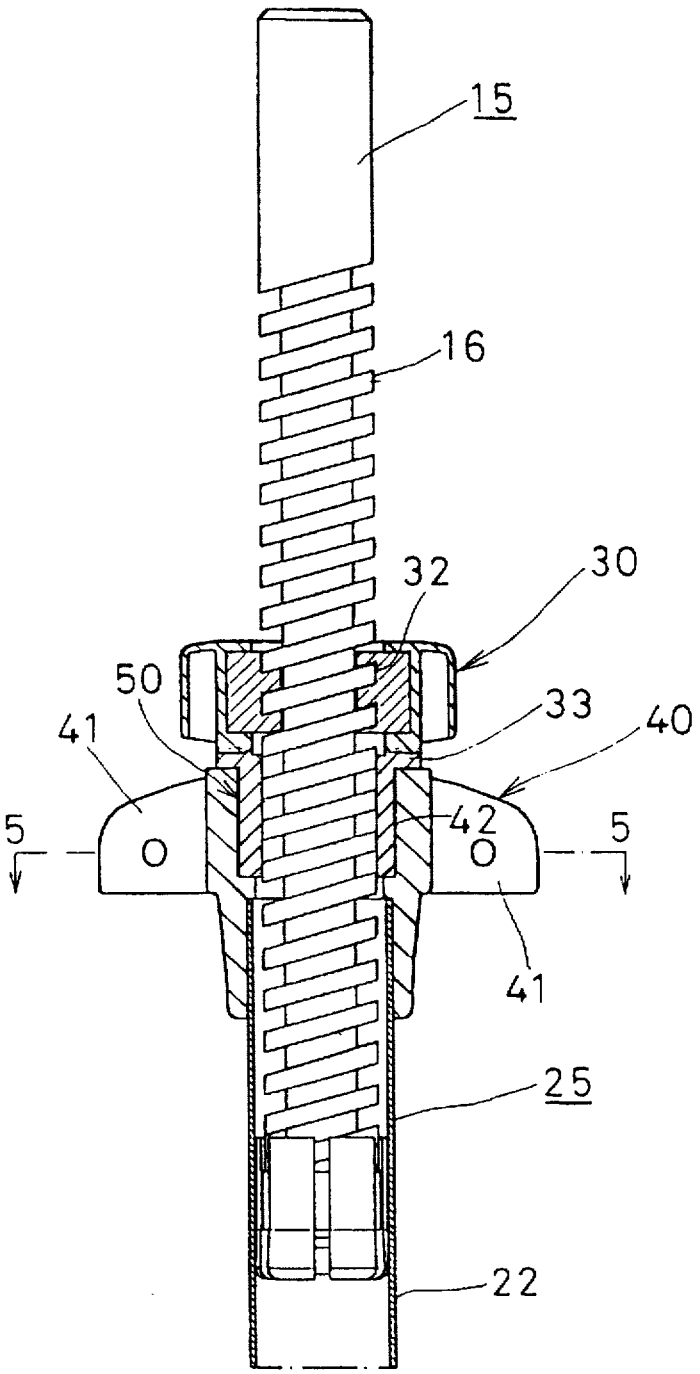
FIG. 2 is a longitudinal section of the essential part of that mechanism.
Figure 9:
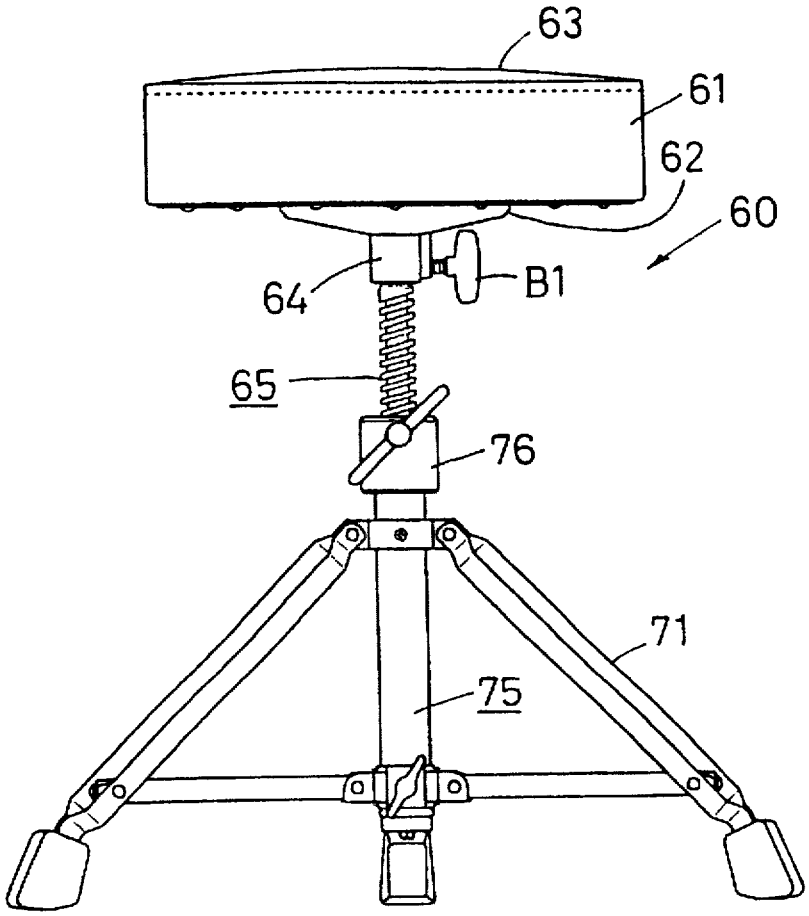
FIG. 9 PRIOR ART
FIG. 9 is a front view of a prior art drum chair.
Figure 10:
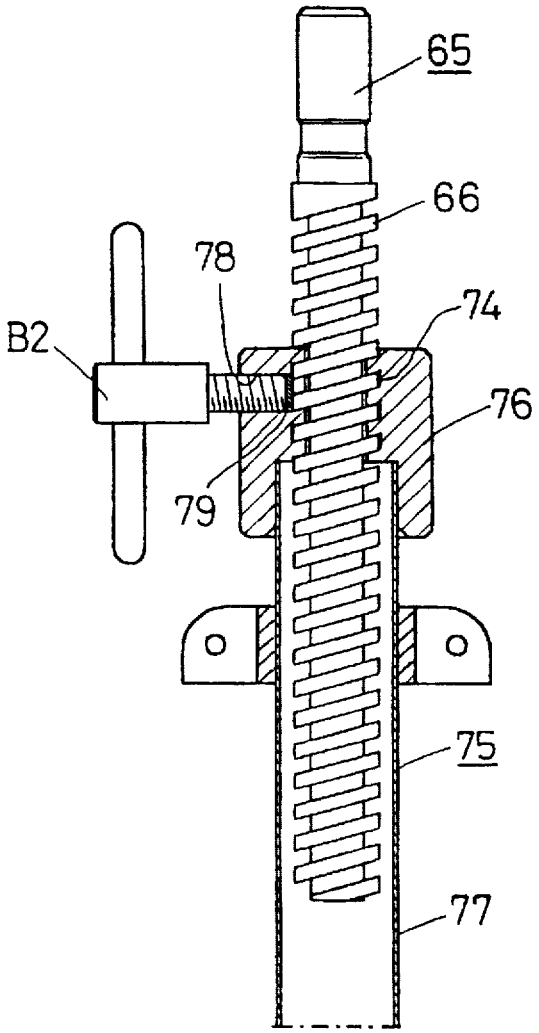
FIG. 10 PRIOR ART
FIG. 10 is a longitudinal view of the height adjustment mechanism of the prior art chair.
Figure 11:
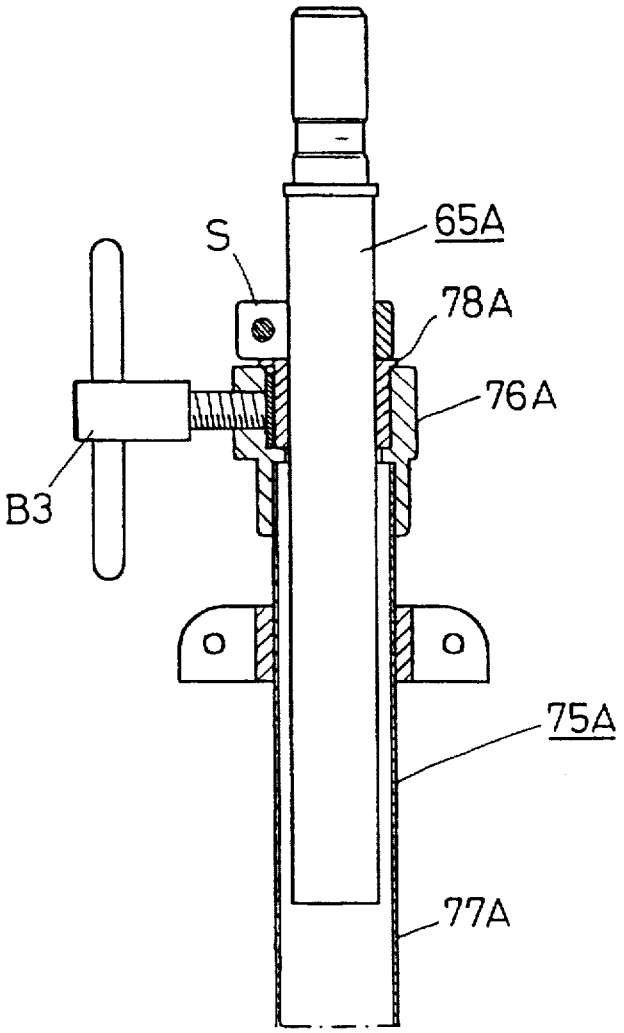
FIG. 11 PRIOR ART
FIG. 11 is a cross section through another ebodiment of a prior art chair.

FIGS. 1 and 2 show a drum chair 10 according to the invention. An upper support 15 supports a seat 11. A lower support 25 carries the upper support. The lower support carries a leg section 21. The height of the upper support 15 can be quickly, easily and accurately adjusted by a rotary member 30 which adjusts against a fixed member 40. These elements permit adjustments ranging from a substantially large adjustment to a fine adjustment, without subsequent loosening of the securement of the seat. The structure of the seat 11 and of the leg section 21 are the same as in prior art FIG. 9 and are not repeated. The seat 11 includes a cushion 13, a seat plate 12, an upper support holding part 14 beneath that plate and a tightening bolt 14A for securing the seat to the upper support.

Figure 3:
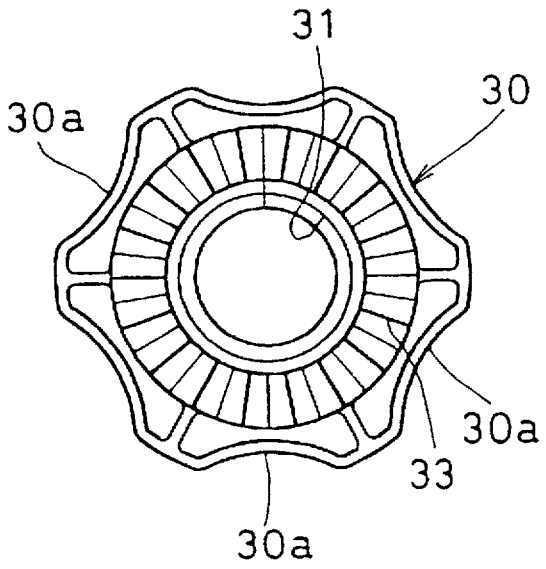
FIG. 3 is a plan view of the rotatable member for adjustment as viewed from its gearing surface side

An external spiral screw thread 16 is provided on the outer peripheral surface of the upper support 15. An internally threaded, rotatable adjustment member 30 is screwed on to the upper support 15 to be freely movable in a vertical direction. The rotatable member 30 is used for fine adjustment of the height of the chair 10. As shown in FIG. 3, the member 30 is a tubular body having a generally hexagonal exterior and having an inner, spiral screw thread 32 in its central hole 31 that may be screwed onto the outside spiral 16.

First rotation inhibiting elements in the form of lower gear toothing 33 are formed on the lower surface of the rotatable member 30. This gear toothing 33 is for meshing with the second rotation inhibiting elements, in the form of upper gear toothing 53 on the tightening part 50, described below. Both gear toothings comprise complementary, meshing convexes and concaves which radiate out from the center. If the rotatable member is supported on the fixed member 40, rotation of the rotatable member 30 moves the upper support 15 vertically according to the pitches of the screw threads.

Figure 4:
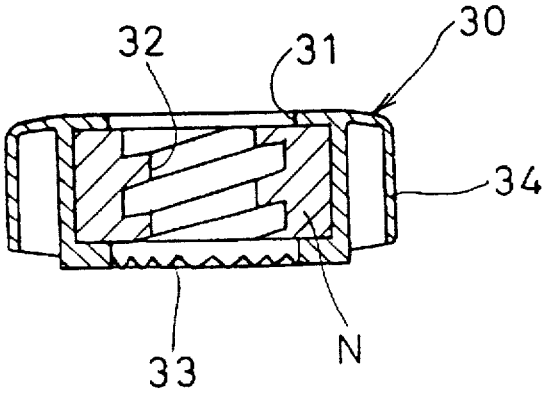
FIG. 4 is a cross section of the rotatable member.

FIGS. 3 and 4 show that the rotatable member 30 has the sides 30*a* of its case 34 defining a generally hexagonal outside shape. Each side 30*a* has a concave surface to make grasping the case easy. An internally threaded nut N is provided inside the member 30.

The lower support 25 has a leg section 21 comprised of a tripod of legs disposed on its outside surface. It has an outer tubular part 22 in which the upper support 15 is inserted and movable up and down.

A fixed member 40 located at the top of the tubular part 22 is used for significantly changing the height of the cushion 13 of the chair 10. It is capable of quickly changing the length of the part of the upper support 15 that is inserted into the tubular part 22 of the lower support 25 and accurately holds that length.

The fixed member 40 is approximately tubular in shape. It includes installation three parts or wings 41 projecting out from its outer surface for receiving the three legs 21.

A separate split ring type of tightening part 50 is disposed inside the inner peripheral surface of the central hole 42 of the tube. The upper support 15 is inserted through a hole through the center of the part 50. A tightening hole 43 through the member 40 opens to the inner surface of the central hole 42. A bolt 17 passes through the tightening hole 43 in the fixed member 40 and presses upon the tightening part 50 which clamps the part 50 on the support 15.

Figure 6:
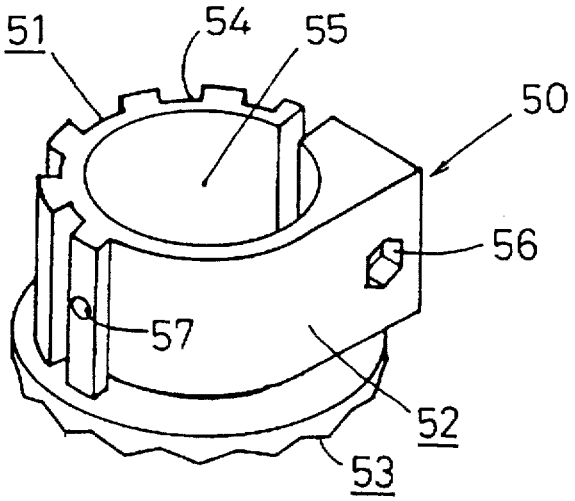
FIG. 6 is a perspective view of the tightening part.
Figure 7:
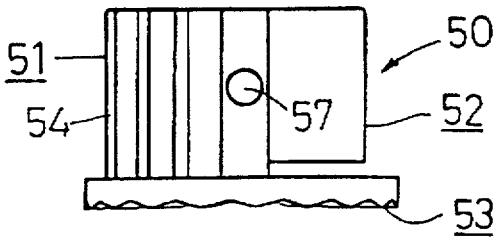
FIG. 7 is a side view of the tightening part.
Figure 8:
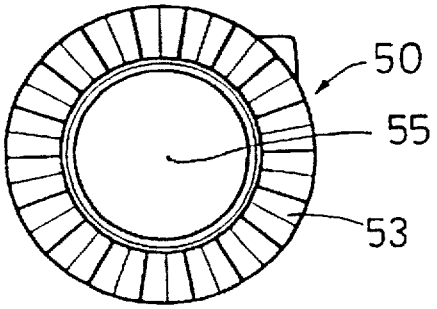
FIG. 8 is a view of the tightening part from the side of the gearing surface.

The split ring type of tightening part 50 shown in FIGS. 6 through 8 firmly and accurately secures the upper support 15 to the lower support 25. The part 50 is made of nylon, or the like strong, sufficiently resilient material, and is formed in the approximate shape of a tube to be installed tightly into the central hole 42 of the said fixing member 40.

The tightening part 50 comprises a main body 51, a tightening body 52 which is urged toward the body 51 for clamping, the upper gearing surface 53 on its underside and its internal holding surface 55 that is clamped to and supports the upper support 15.

The main body 51 is formed in the shape of a divided tube or split ring, with peripheral gear teeth formed along the longitudinal direction in its outer peripheral surface. The peripheral teeth 54 are meshed into the cooperating teeth 44 provided in the inner peripheral surface of the central hole 42 of the fixed member 40. This fixes the main body 51 of the tightening part 50 to the inner surface of the hole 42 in the fixed member 40.

The tightening body 52 has generally the shape of a belt extending from one edge of the main body 51 and the body 52 surrounds the upper support 15 that is to be inserted into the holding part 55. A holding part 56 at the end of the tightening body 52 firmly presses on the upper support 15 when the tip of the tightening bolt 17 presses on the part 56. In this example, a hexagonal nut is arranged inside the holding part 56 to be engaged by the bolt 17.

A pin hole 57 is formed on the side of the base part of the tightening body 52 receives an inserted spring pin P that holds the fixing member 40 and the tightening part 50 together preventing separation in the longitudinal direction.

The gearing surface 53 is made of annular bodies that surround the holding part 55 like a flange. The gearing surface 53 is formed on the surface of the part 50 which is opposite to the rotary member 30. The gearing surface 53 prevents rotary movement of the rotary member 30 and thereby prevents adjustment during the use of the chair 10 by meshing between the gearing surface 53 on the part 50 and the gearing surface 33 of the rotatable member 30 for adjusting and for maintaining the height of the chair to a desired height. The radial shape mates with the gearing shape of the gearing surface 33.

The gearing surfaces 33 and 53 come into mesh and are firmly fitted into each other when a load is applied to the chair 10 or when a person is seated. As a result, even if the tightening bolt 17 may be loosened by vibrations during a performance, the position of the fixed member 40 does not change nor is the seat lowered.

The convex-concave shape of the meshed gearings are such that the gears can easily separate when there is no load. The fitted state can be easily removed when the tightening bolt 17 is loosened when there is no load or when no one is seated. As a result, the adjustment of the seat height is not adversely affected.

Figure 5:
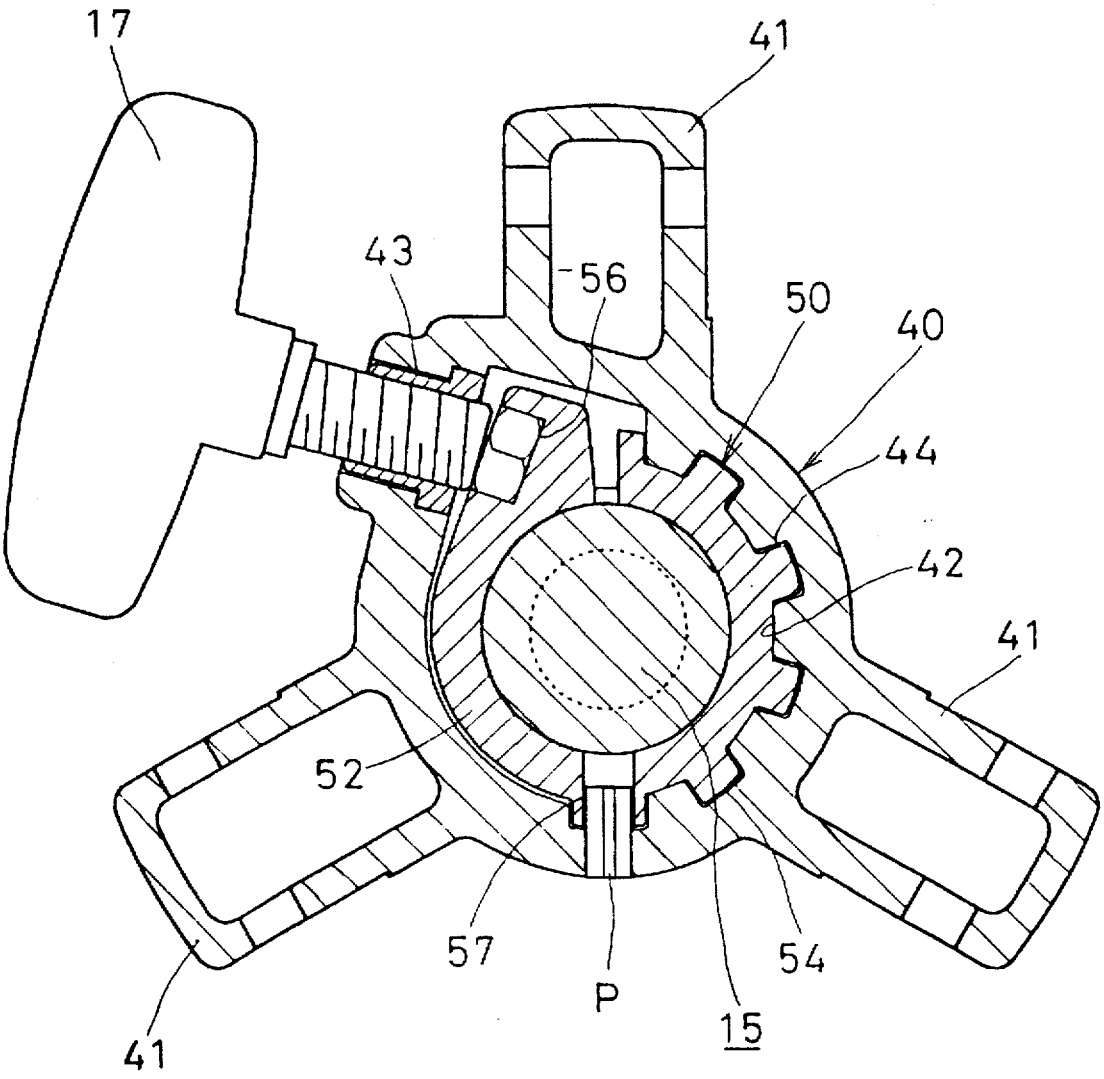
FIG. 5 is a cross section view along line 5—5 in FIG. 2.

The upper support 15 is held by the fixed member 40 in the following manner. Referring to FIG. 5, the tightening bolt 17 is screwed into the tightening hole 43 of the fixed member 40 until its tip presses against the holding part 56 at the tip of the tightening body 52 of the tightening part 50. Since the main body 51 of the tightening part 50 is fixed inside the central hole of the fixed member 40 by gearing 54 the upper support 15 is clamped by a band-like tightening by the body 52.

The method of adjusting the height of the drum chair using the above height adjusting mechanism is explained with reference to FIG. 2.

To adjust the seat substantially, the tightening bolt 17 is loosened, which releases the upper support from being clamped by the tightening part 50. When the seat is to be lowered, the rotatable member 30 is rotated by hand to move it above the lower support 25. The upper support 15 and the lower support 25 are in a free state enabling the upper support 15 to be freely elevated or lowered with reference to the lower support 25. When the seat has been moved to a desired height, the rotatable member 30 is rotated to move closer to the fixed member 40. After its gearing surface 33 has been meshed with the gearing surface 53 of the tightening part of the fixed member 40, the tightening bolt 17 is tightened, which fixes the upper support 15 to the lower support 25.

To raise the seat, the tightening bolt 17 is loosened, and the upper support 15 is pulled out of the tubular part 22 for a desired length to elevate the seat. The rotatable member 30 is rotated to move closer to the fixed member 40. After the gearing surfaces 33 and 53 have meshed, the fixed member 40 is tightened by the tightening bolt 17 and the upper support 15 is pressed against the lower support 25 for fixing.

Fine adjustment of the height of the seat is carried out as follows. To elevate the seat, the tightening bolt 17 is loosened to release the clamped connection between the lower support 25 and the upper support 15. Then the rotatable member 30 is rotated to adjust the direction in which the seat is lifted (clockwise, as viewed from above the seat in this example).

The engagement between the gearing surfaces 33 and 53 is automatically released as the rotatable member 30 is rotated. Since the upper support 15 rises or lowers by the pitch of the outer spiral portion 16, fine adjustment becomes possible. It is only necessary to retighten the tightening bolt 17 when the seat has been raised to its desired height, thereby again fixing the upper support 15 to the lower support 25.

When the seat is to be lowered, on the other hand, the tightening bolt 17 is loosened, which frees the upper support 15 from the lower support 25. The rotatable member 30 is rotated by hand (counter-clockwise in this case) and, after the seat has been lowered to a desired height, the tightening bolt 17 is retightened. The gearing surfaces 33 and 53 are easily fitted to each other due to the weight of the seat and the upper support.

The height adjustment mechanism enables adjustment of the height by rotating the rotatable member 30. This makes it convenient for operation at a narrow place. Where the direction of the chair is fixed due to the presence of a supportive back, moreover, it still can be conveniently used. The height can also be adjusted by rotating the seat of the chair as in conventional chairs because this will rotate the upper support with respect to the member 30.

As explained above, substantial adjustment of the height of the seat can be done with the fixed member while fine adjustment of the height can be done with the rotatable member easily and accurately in both cases. As there is no need to rotate the seat for height adjustments, moreover, it is extremely effective in the case where an adjustment is required at a narrow place or in the case where the chair has a directional character.

Since the fixed member and the rotatable member are fitted to each other through their respective meshed gearing surfaces, the user can be seated confidently and without sudden movement of the seat even if the tightening bolt is loosened. As the meshed condition of the gearing surfaces can be easily released when there is no load, no trouble is required for adjustment.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A height adjustment mechanism for a chair seat comprising:

an upper support, for the seat;

a lower support for chair legs, the lower support being below the upper support, one of the upper and lower supports being movable into and out of the other for adjusting the height of the seat above the lower support;

the upper support having an outer screw thread formed around it;

a rotatable adjustment member threaded on the outer screw thread of the upper support, such that rotation of the rotatable member in opposite directions moves the rotatable member selectively up or down along the upper support; the rotatable member having a lower surface with upper rotation inhibiting elements thereon;

a fixed member disposed around the upper support beneath the rotatable member and above the lower support and having an opening through which the upper support may be slid; the fixed member having an upper surface with lower rotation inhibiting elements thereon shaped to mesh with the upper rotation inhibiting elements on the underside of the rotatable member so that when the upper and lower rotation inhibiting elements are in engagement, the rotatable member is prevented from rotating with reference to the fixed member;

a tightening part at the fixed member for compressively tightening the fixed member on the upper support above the lower support and for being loosened to release the fixing member from comprehensive tightening on the upper support, whereby with the tightening part loosened, the upper support is free to be raised and lowered through the opening in the fixed member.

2. The mechanism of claim 1, wherein the upper and the lower rotation inhibiting elements comprise respective upper and lower gearing with generally radially directed gear teeth shaped so as to mesh when the upper and lower gearings are in engagement.

3. The mechanism of claim 1, wherein the fixed member comprises a split ring around the upper support and the tightening part comprises elements for clamping the split ring around the upper support.

4. The mechanism of claim 3, wherein the fixed member has external third rotation inhibiting elements thereon and the tightening part has fourth rotation inhibiting elements which engage the third rotation inhibiting elements for preventing rotation of the fixed member with reference to the tightening part.

5. The mechanism of claim 3, wherein the tightening part passes around the fixed member which is around the upper support.

6. The mechanism of claim 1, wherein the tightening part includes a portion thereof in engagement with the lower support for positioning the tightening part with reference to the lower support.

7. The mechanism of claim 1, wherein the lower support is a tubular part into and out of which the upper support is movable.

8. The mechanism of claim 1, wherein the rotatable member is externally shaped enabling manual grasping thereof.

* * * * *